United States Patent [19]

Rice et al.

[11] 4,430,827

[45] Feb. 14, 1984

[54] PICK-UP VEHICLE

[76] Inventors: Francis X. Rice, 212 Valley Rd., River Edge, N.J. 07661; Andrey V. Mackey, 42 Lawrence La., Ambler, Pa. 19002

[21] Appl. No.: 413,244

[22] Filed: Aug. 30, 1982

[51] Int. Cl.[3] ..... A63H 11/10

[52] U.S. Cl. ..... 46/202; 46/222

[58] Field of Search ..... 46/202, 201, 251, 214, 46/116, 204, 205, 222

[56] References Cited

U.S. PATENT DOCUMENTS

| | | | |
|---|---|---|---|
| 2,444,961 | 7/1948 | Smith | 46/216 X |
| 3,667,154 | 6/1972 | Aoki | 46/202 X |
| 4,262,443 | 4/1981 | Ferris et al. | 46/103 |

*Primary Examiner*—Mickey Yu

*Attorney, Agent, or Firm*—Jay M. Cantor

[57] ABSTRACT

A toy push type vehicle with front and rear doors, each door being individually operated either by a handle thereon or by a push down projection on the bus roof whereby objects, such as figures of humans with an annular groove in the base region thereof, are forced into the vehicle upon movement thereof by means of the open front door and vehicle forward movement. The object moves along a slot disposed between the rear and front doors and within the vehicle which is of slightly greater width than the width of the groove in the object base region. The object has sufficient length beneath the groove to be in contact with the floor upon which the vehicle is being pushed. In this manner, the object slides along the slot within the vehicle toward the rear door due to friction between the object and the floor. Because the slot extends from the front door to the rear door, the object will move toward the rear door and be stopped at either the rear door or by another figure between the object and the rear door. Upon further movement of the vehicle forward and opening of the rear door, the object will move out of the rear door due to the friction between the floor and the object whereupon the object will exit the vehicle. The vehicle can be in the form of a bus carrying objects in the shape of people or it can be a truck carrying objects to be loaded and unloaded therefrom of other types.

18 Claims, 6 Drawing Figures

PICK-UP VEHICLE

BACKGROUND OF THE INVENTION

1. FIELD OF THE INVENTION

This invention relates to toy vehicles and, more specifically, to the animated movement of objects into, through and out of a vehicle by forward movement of the vehicle and proper operation of the vehicle doors.

2. DESCRIPTION OF THE PRIOR ART

Toy vehicles having objects contained therein are well known in the prior art. The prior art also discloses systems for moving objects into, within and out of the vehicle. However, these devices normally require motor operated conveyors and the like for object movement. Such devices are relatively complex, relatively expensive and require a relatively mature child for proper operation.

SUMMARY OF THE INVENTION

Briefly, in accordance with the present invention, there is provided a toy vehicle capable of having objects enter the open front door thereof, move from front to back due to friction between the floor and the object entering the vehicle and then exit from the rear door of the vehicle upon opening of the rear door, all due to forward movement of the vehicle itself. This is accomplished by means of a slot extending from front to rear door of the vehicle within the vehicle and a groove formed on the object to move through the vehicle whereby, when the vehicle is pushed forwardly, the bottom of the object can enter the front door of the vehicle, the groove on the object will then mate with the slot within the vehicle and move along the slot, the portion of the object disposed below the slot having sufficient height so that it can contact the floor and be moved rearwardly of the vehicle upon vehicle movement due to friction therewith with the floor. The front and rear doors of the bus are opened either by means of handles on the doors or by means of push devices on the vehicle roof or by other means which will cause the doors to open individually. The combination of open front door and forward vehicle movement will force objects into the front of the vehicle and into the slot whereas the combination of an open rear door and forward vehicle movement will force the objects along the slot and out of the rear door.

DESCRIPTION OF THE PREFERRED EMBODIMENTS

Figure 1:
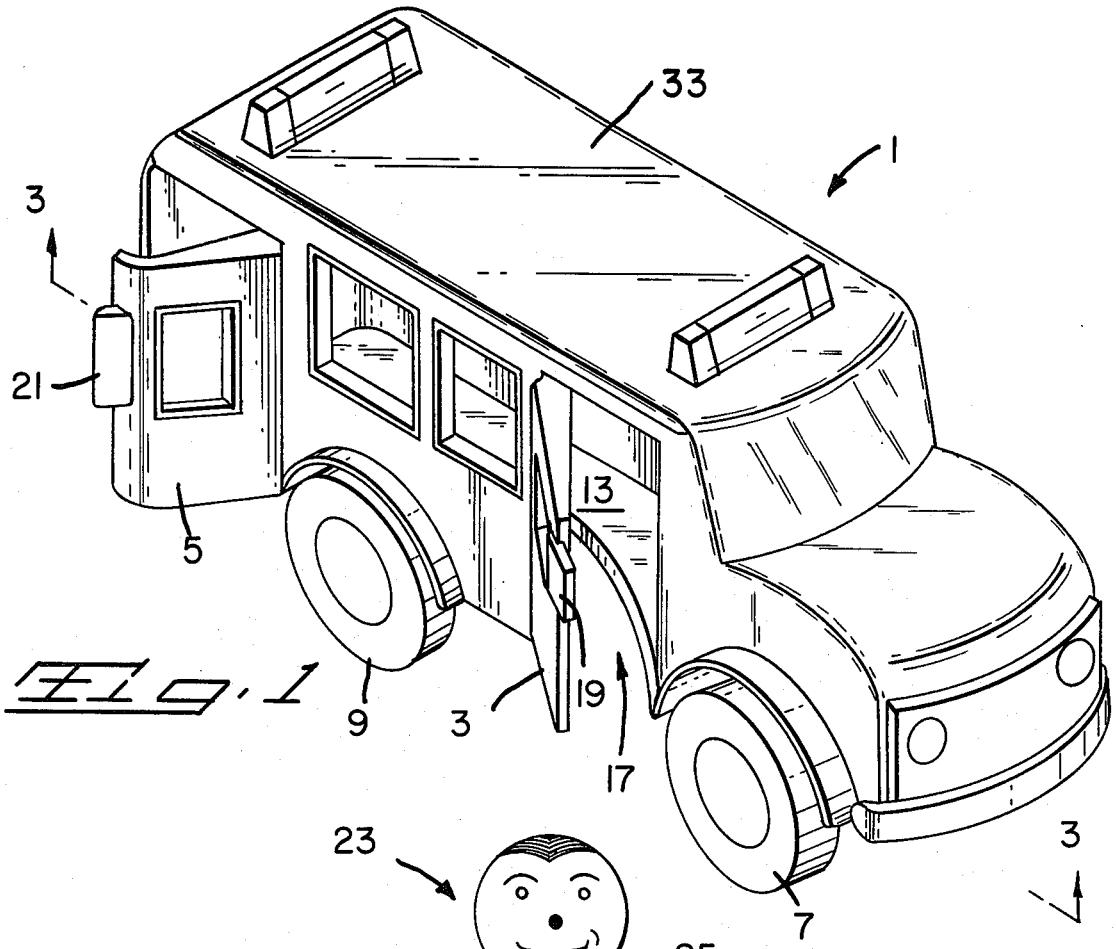
FIG. 1 is an elevational view of a vehicle in accordance with a first embodiment of the present invention.
Figure 3:
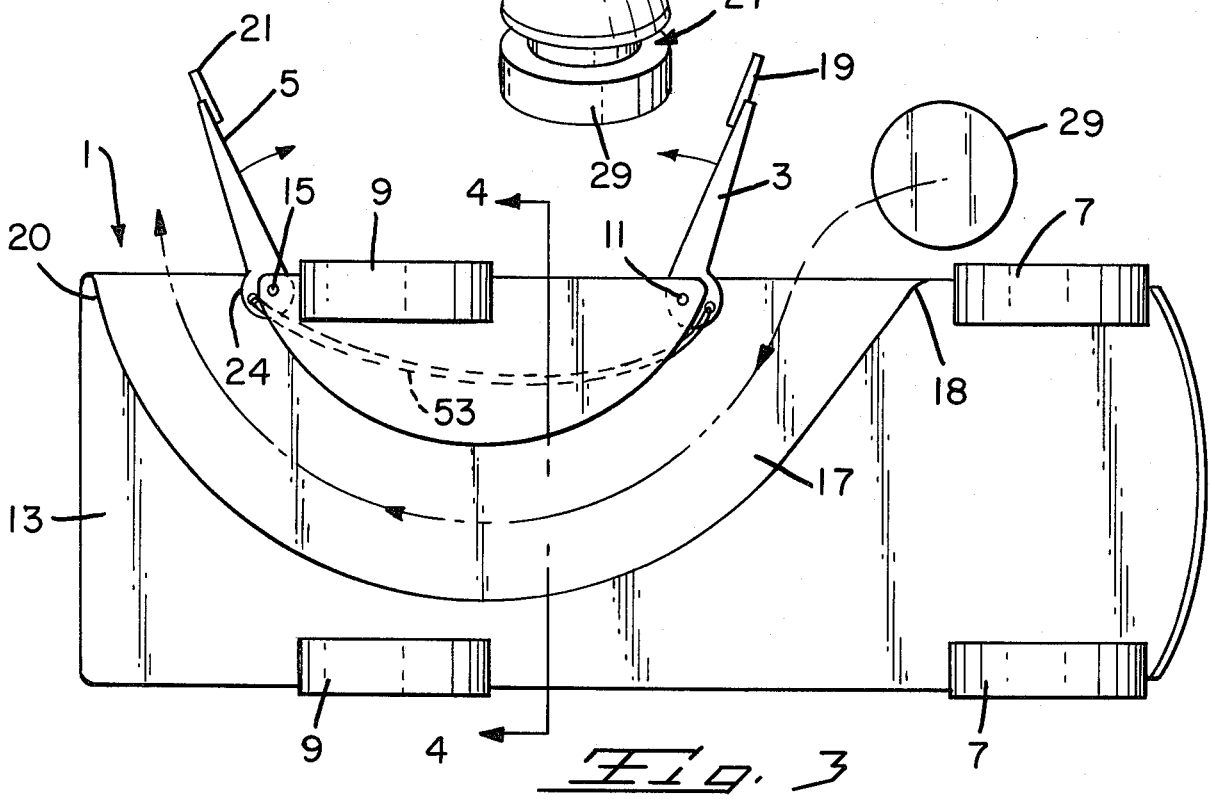
FIG. 3 is a bottom view of the vehicle of FIG. 1 taken along the line 3—3 of FIG. 1.
Figure 4:
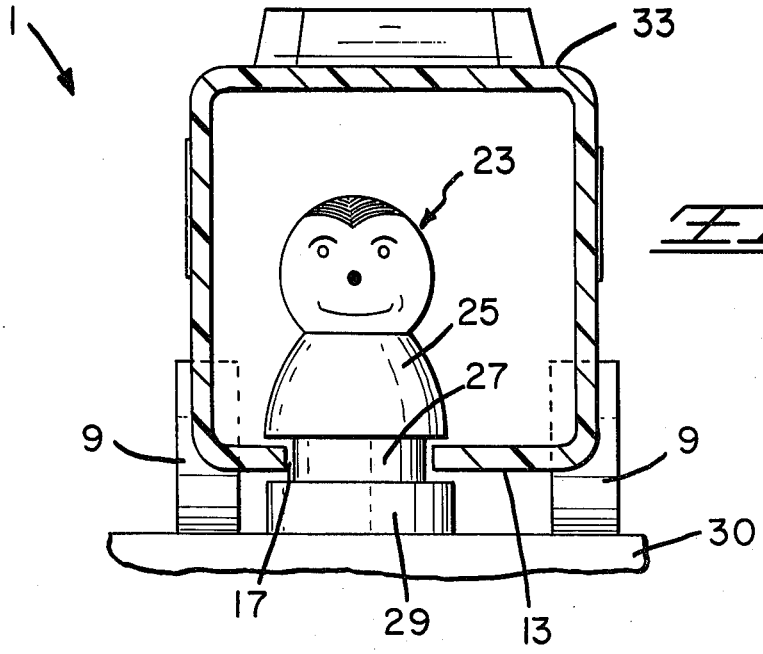
FIG. 4 is a view taken along the lines 4—4 of FIG. 3 also including the object of FIG. 2.

Referring now to FIGS. 1, 3 and 4, there is shown a vehicle 1 having a front door 3, a rear door 5 and a pair of front wheels 7 and rear wheels 9. The front door 3 is pivoted at the pivot 11 for outward opening, the pivot 11 being positioned at the side of the door 3 toward the rear of the vehicle 1. The rear door 5 is pivoted at the pivot 15 for outward opening, the pivot 15 being at the side of the door positioned toward the front end of the vehicle. The front door 3 includes an opening member 19 and the rear door 5 includes an opening member 21, each opening member being a flange attached to the door to be grasped by the operator for rotation of the respective doors about their respective pivots as mentioned hereinabove. A rubber band 53 is secured to each of the doors 3 and 5 at the extension finger 24 to bias the doors in the closed position. Therefore, opening of the doors by movement against the flange 19 or 21 will be a movement of the respective door against the bias of the rubber band 53. The underside of the vehicle 1 includes a floor 13 having a slot 17 formed therein which extends continuously from the front door 3 to the rear door 5. The slot 17 is flared at the terminal portions 18 and 20 thereof for reasons to be explained hereinbelow.

Figure 2:
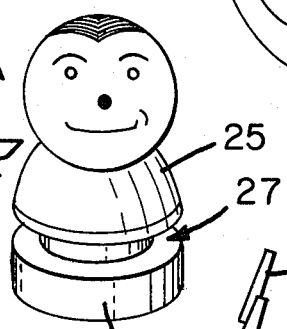
FIG. 2 is an elevational view of an object in accordance with the present invention.

Objects 23 are provided for entry into the vehicle 1 through the front door 3, moving therein along the slot 17 with later exit through the rear door 5 as will be explained. Such an object is shown in FIGS. 2 and 4 in the form of a passenger. With reference to FIGS. 2 and 4, the passenger 23 includes a top portion 25, a groove 27 formed near the base and a base portion 29. The thickness of the groove 27 will be greater than the thickness of the floor portion 13 in the region of the slot 17 as shown in FIG. 4. Also, the height from the bottom of the base region 29 to the top of the slot 27 will be greater than the distance from the top of slot 17 to the bottom of the wheels 7 and 9 whereas the height of the base 29 itself will be equal to or less than the distance from the bottom of slot 17 in floor 13 to the bottom of the wheels 7 and 9. In this way, when the vehicle 1 is positioned on a base such as a floor, the passenger 23 can be positioned with the slot 17 disposed in the groove 27 as shown in FIG. 4 and the bottom of the base 29 positioned on the floor 30. In this way, forward movement of the vehicle 1 will cause the passenger 23 to move along the slot 17 from the front of the vehicle to the rear of the vehicle due to the friction between the floor 30 and the bottom of the base portion 29.

In operation, the passenger 23 as shown in FIG. 4, will be positioned on a surface, such as a floor 30 with the base portion 29 thereof positioned on the floor. The operator will then open the front door 3 of the vehicle 1 by rotating the door due to application of a force at the flange 19 to provide a clockwise rotation as shown in FIGS. 1 and 3. With the door 3 open, the vehicle will be moved in a forward position so that the passenger 23 is positioned between the open door 3 and the side of the vehicle 1. This funnel shaped form between the door and the vehicle will force the passenger 23 into the forward flanged part 18 of the slot 17 and cause the passenger to move therein along the slot until its movement is impeded by the rear door 5 or by another passenger positioned therebetween and the rear door 5. In order to have the passenger exit from the vehicle, the rear door 5 is opened by counter-clockwise rotation thereof as shown in FIGS. 1 and 3 by applying a force to the flange 21 thereon. Accordingly, with the door 5 open and the vehicle moved in a forward direction, the friction between the floor 30 and the passenger 23 will cause the passenger to move along the slot 17 and outwardly at the flanged rear portion 20 of the slot through the door 5.

Figure 5:
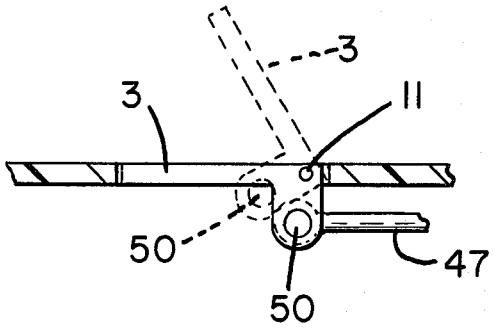
FIG. 5 is a view taken along the lines 5—5 of FIG. 6.
Figure 6:
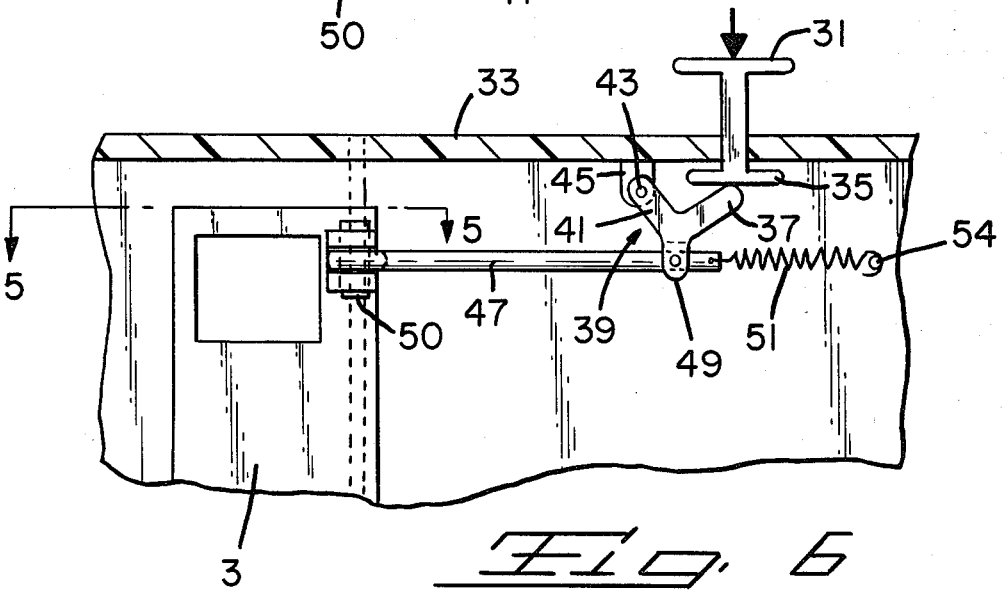
FIG. 6 is a second embodiment of a door opening and closing mechanism.

Referring now to FIGS. 5 and 6, there is shown a second embodiment of the present invention. In accordance with the second embodiment, all features described hereinabove with respect to the first embodiment are the same except for the manner of opening the doors 3 and 5 and biasing them normally closed. As can be seen from FIG. 6, there is provided a push down element 31 above the roof 33 of the vehicle 1. The push down element includes a disc portion 35 which contacts a lobe 37 on a three lobed element 39. A second lobe 41 of the three lobed element 39 includes a pivot 43 which is pivotally mounted to a finger 45 which is secured to and depends from the roof 33 of the vehicle 1. A rod 47 connected to the door 3 at the pivot 50 is rotatably secured to the lobe 49 of the three lobed member 39. A spring 51 is also secured to the rod 47 at one end and is secured to the side of the vehicle at its other terminus 54. It can be seen that when the push down member 31 is pushed down in the direction of the arrow, the three lobed member 39 will rotate in a clockwise direction around the pivot 43 and cause the rod 47 to move to the left, thereby opening the door to which it is attached, as shown in phantom in FIG. 5. When the downward force is removed from the push down member 31, the rod 47 will move to the right due to the bias thereto from the spring 51, thereby causing the door 3 to close. There is one such door opening mechanism for each door. In all other respects, this embodiment operates in the same manner as the embodiment disclosed hereinabove with regard to FIGS. 1 through 4.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A toy vehicle which comprises:

(a) a housing including a planar floor portion, forming an external surface thereof, (b) support means secured to said housing and depending below said floor portion, (c) a pair of openings each disposed in an outer surface of said housing which have a major component of one axis thereof substantially normal to said floor and spaced from each other, (d) a continuous slot formed in said floor and extending between said two openings, and (e) object means responsive to movement of said vehicle in a predetermined direction parallel to the plane of said floor portion for movement along said slot.

2. A toy vehicle as set forth in claim 1 wherein said support means are wheels.

3. A toy vehicle as set forth in claim 1 further including a door pivotally secured in each said opening and rotatable in a direction out of said housing.

4. A toy vehicle as set forth in claim 2 further including a door pivotally secured in each said opening and rotatable in a direction out of said housing.

5. A toy vehicle as set forth in claim 1 wherein said slot flares outwardly at at least one end region thereof.

6. A toy vehicle as set forth in claim 2 wherein said slot flares outwardly at at least one end region thereof.

7. A toy vehicle as set forth in claim 3 wherein said slot flares outwardly at at least one end region thereof.

8. A toy vehicle as set forth in claim 4 wherein said slot flares outwardly at at least one end region thereof.

9. A toy vehicle as set forth in claim 1 wherein said object means includes a groove matable with said slot, the bottom of said object means extending below said floor a distance substantially the same as the bottom of said support means when said slot is mated with said groove.

10. A toy vehicle as set forth in claim 3 wherein said object means includes a groove matable with said slot, the bottom of said object means extending below said floor a distance substantially the same as the bottom of said support means when said slot is mated with said groove.

11. A toy vehicle as set forth in claim 5 wherein said object means includes a groove matable with said slot, the bottom of said object means extending below said floor a distance substantially the same as the bottom of said support means when said slot is mated with said groove.

12. A toy vehicle as set forth in claim 7 wherein said object means includes a groove matable with said slot, the bottom of said object means extending below said floor a distance substantially the same as the bottom of said support means when said slot is mated with said groove.

13. A toy vehicle as set forth in claim 8 wherein said object means includes a groove matable with said slot, the bottom of said object means extending below said floor a distance substantially the same as the bottom of said support means when said slot is mated with said groove.

14. A toy vehicle as set forth in claim 3 further including biasing means secured to said doors biasing them normally closed.

15. A toy vehicle as set forth in claim 4 further including biasing means secured to said doors biasing them normally closed.

16. A toy vehicle as set forth in claim 10 further including biasing means secured to said doors biasing them normally closed.

17. A toy vehicle as set forth in claim 13 further including biasing means secured to said doors biasing them normally closed.

18. A toy vehicle as set forth in claim 17 wherein said biasing means includes a rotatable member secured in said housing, a rod secured to a said door and said rotatable member for opening and closing said door responsive to movement thereof, a spring biasing said rotatable member in a predetermined position and means extending to the exterior of said housing for rotating said rotatable member against said bias.

* * * * *